US008061429B2

(12) United States Patent
Du et al.

(10) Patent No.: US 8,061,429 B2
(45) Date of Patent: Nov. 22, 2011

(54) SYSTEMS AND METHODS FOR DOWNHOLE COMPLETIONS

(75) Inventors: Michael H. Du, Pearland, TX (US); Gary Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 365 days.

(21) Appl. No.: 12/345,987

(22) Filed: Dec. 30, 2008

(65) Prior Publication Data

US 2010/0163249 A1 Jul. 1, 2010

(51) Int. Cl.
*E21B 23/04* (2006.01)

(52) U.S. Cl. ..... 166/377; 166/380; 166/242.6

(58) Field of Classification Search ..... 166/381, 166/242.6, 378, 380, 377
See application file for complete search history.

(56) References Cited

U.S. PATENT DOCUMENTS 5,318,117 A 6/1994 Echols
5,697,449 A 12/1997 Henning
5,957,209 A * 9/1999 Burleson et al. ..... 166/380
6,213,206 B1 * 4/2001 Bakke ..... 166/242.7
6,425,443 B1 * 7/2002 Hill et al. ..... 166/377
6,732,822 B2 5/2004 Slack
2003/0221837 A1 12/2003 Giroux
2007/0062687 A1 3/2007 Layton
2008/0041477 A1 2/2008 Shotter
2008/0105436 A1 5/2008 Molina

FOREIGN PATENT DOCUMENTS

WO 9953170 10/1999
WO 2008057654 5/2005

* cited by examiner

*Primary Examiner* — David Andrews
(74) *Attorney, Agent, or Firm* — Brandon Clark; Rodney Warfford; Robb Edmonds

(57) ABSTRACT

Systems and methods for downhole completions. A downhole running tool can have a body having a bore formed therethrough. A latch member can be disposed on a first portion of the body. A reset member can be disposed on a second portion of the body. A conduit can be formed within a sidewall of the body. The conduit can be located between the first and second portions of the body. A pressure relief port can be disposed at a first end of the conduit; and a first flow port can be disposed at a second end of the conduit. The pressure relief port and first flow port can be in communication with an outer diameter of the body.

12 Claims, 4 Drawing Sheets

SYSTEMS AND METHODS FOR DOWNHOLE COMPLETIONS

BACKGROUND

Hydrocarbon fluids such as oil and natural gas are obtained from subterranean geological formations, which are referred to as reservoirs. To recover hydrocarbons from a reservoir, a well that penetrates the reservoir can be drilled. After the well is drilled, a well completion assembly can be used to complete the well before hydrocarbons can be produced.

A typical well completion assembly can be located or installed in the well, and can have a hydraulic control system or flowpath used to convey or pump control fluids to downhole valves used to control production from the well or injection of fluids into the well. The well completion assembly is often installed in the well using a running-tool. During run-in operations, it maybe desirable to protect the hydraulic control system or flowpath of the well completion assembly.

Particularly, it can be desirable to protect the hydraulic control system or flowpath of the well completion assembly from ambient fluids, such as wellbore fluids, during the run-in with the running tool. Such ambient fluids can damage the hydraulic control system of the completion. In addition, the wellbore can have temperature gradients. Such temperature gradients can cause pressure variations, which can damage the hydraulic control system of the completion.

There is a need, therefore, for a running-tool that can protect the hydraulic control system or flowpath from excessive pressure variations during run-in operations.

SUMMARY

Systems and methods for running-in downhole equipment are disclosed. The downhole equipment can have at least one hydraulic control system. One or more embodiments of the systems and methods can use a downhole running tool. The downhole running tool can have a body. The body can have an annulus formed therethrough. A latch member can be disposed on a first portion of the body. A reset member can be disposed on a second portion of the body. A conduit can be formed within a sidewall of the body. The conduit can be located between the first and second portions of the body. A pressure relief port can be disposed at a first end of the conduit; and a first flow port can be disposed at a second end of the conduit. The pressure relief port and first flow port can be in communication with an outer diameter of the body and can be prevented from communicating with the annulus of the body.

One or more embodiments of the method for running-in downhole equipment with a hydraulic control system can include locating a completion system downhole. The completion system can include a first assembly and a second assembly. In one or more embodiments, the first assembly can be the downhole running tool. The second assembly can include a housing with a bore formed therethrough. The first assembly can be disposed at least partially within the bore of the housing. A first portion of the housing can be engaged with the latch member. A second flow port can be formed into the housing and sealed off from the exterior diameter of the housing. The second flow port can be engaged with the first flow port. A second conduit can be formed within a sidewall of the housing and can be in communication with the second flow port. A protection mechanism can be disposed within a second portion of the bore of the housing and engaged with the reset member. The second conduit can be protected from pressure buildup and external fluid as it is located downhole.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
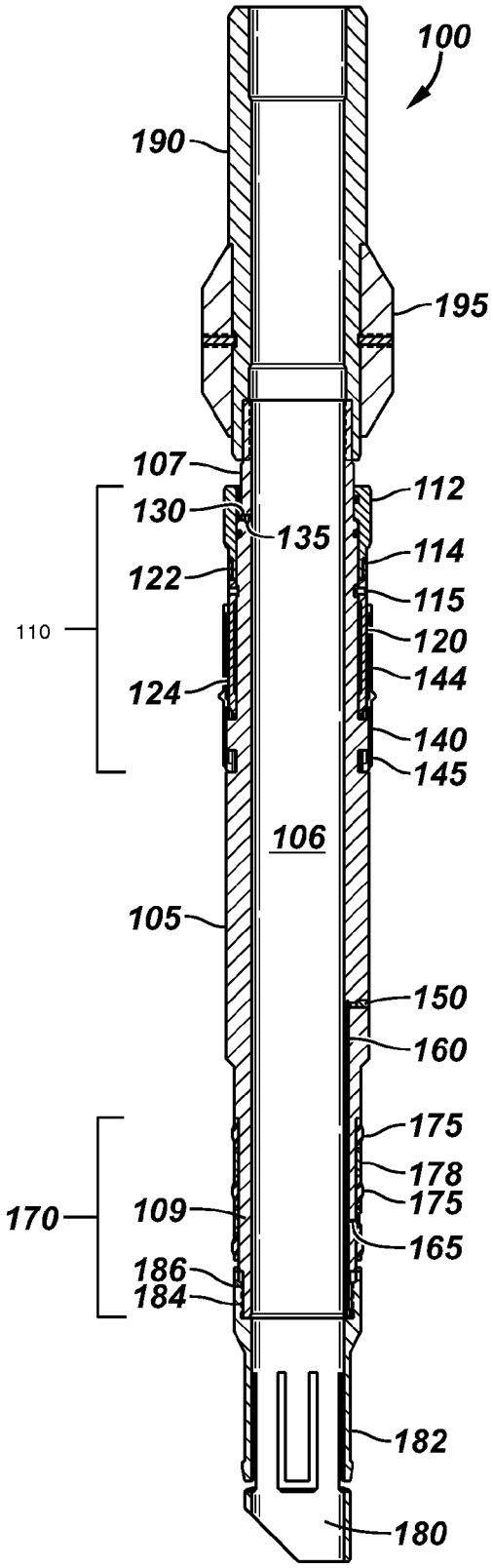
FIG. 1 depicts a partial cross section of an illustrative downhole running tool, according to one or more embodiments described.

FIG. 1 depicts a partial cross section of an illustrative downhole running tool, according to one or more embodiments. The downhole running tool 100 can be used to run equipment or completions with one or more hydraulic control systems downhole. The downhole running tool 100 can include a body 105, a latch member 110, a reset member 180, and a conduit 160 formed within a sidewall of the body 105. The body 105 can be an elongated member, such as a tubular, having an annulus or bore 106 formed therethrough.

The latch member 110 can be disposed on an "upper" or first portion 107 of the body 105. In one or more embodiments, the latch member 110 can include at least one sleeve and a collet 140. The sleeve 112 can be disposed about an outer surface of the body 105 and adapted to axially move about the outer surface of the body 105, and at least a portion of the collet 140 can disposed about an outer diameter of the sleeve 112. In one or more embodiments, the latch member 110 can include an "upper" or first ring or sleeve 112 disposed about the first portion 107 of the body 105. The first sleeve 112 can serve as a piston that translates axial forces to a lower ring or second sleeve 120. The second sleeve 120 can be a tubular member disposed about the body 105 and can be adjacent a "lower" or second portion 114 of the first sleeve 112. A portion of the outer diameter of the second portion 114 of the first sleeve 112 can be tapered to form a recess or shoulder for contacting a corresponding shoulder or recess formed into the inner diameter of an "upper" or first portion 122 of the second sleeve 120, as depicted in FIG. 1. Accordingly, the first portion 122 of the second sleeve 120 and the second portion 114 of the first sleeve 112 can be concentrically disposed about the body 105, and the second portion 114 of the first sleeve 112 can contact the body 105.

One or more shear pins 115 can be used to connect or otherwise affix the second sleeve 120 to the body 105. The shear pin 115 can be designed to break when a force is applied to it. For example, force can be applied to the shear pin 115 by the first sleeve 112 shifting the second sleeve 120 axially. In one or more embodiments, the shear pin 115 can be located between the first portion 122 and a second portion 124 of the second sleeve 120. In one or more embodiments, the shear pin 115 can extend through the second sleeve 120 and threadably connect to the body 105.

A hole or opening can be formed radially through the body 105 forming a port 130. The port 130 can extend from the inner diameter of the body 105 to the outer diameter of the body 105. The port 130 can allow for communication between the bore 106 and the first sleeve 112. A pressure sensitive component 135 can be sealingly disposed within the cross port 130. The pressure sensitive component 135 can be a rupture disk or other frangible member. The pressure sensitive component 135 can be designed to break at a predetermined pressure. The pressure sensitive component 135 can prevent communication between the first sleeve 112 and the bore 106; however, the bore 106 and the first sleeve 112 can communicate, when the pressure sensitive component 135 is ruptured.

The latch member 110 can include a collet 140 disposed about the body 105. In one or more embodiments, the collet 140 can be a snap latch collet. The collet 140 can include two or more segmented fingers or extensions 144 that can be configured to engage an upper portion of a completion assembly (not shown in FIG. 1). Threads 145 can be formed on the outer diameter of the collet 140. The threads 145 can be left hand threads. The second portion 124 of the second sleeve 120 can be at least partially disposed between the fingers or extensions 144 and the body 105. The second end 124 of the second sleeve 120 can prevent the fingers or extensions 144 of the collet 140 from bending towards the central axis of the body 105.

In one or more embodiments, the latch member 110 can be different from the one described herein. In one or more embodiments, the latch member 110 can be any latch mechanism configured to be actuated or released by applying pressure to a control line, by the use of a shifting tool, or any other device that can releasably secure the downhole running tool 100 to a completion or second assembly, such as a second assembly 200. In one or more embodiments, the latch member 110 can be a combination of an atmospheric chamber (not shown) sealed within one end of a piston (not shown), and the piston can be actuated by applying pressure to the other end of the piston; thereby, shifting the piston and actuating a latch (not shown) that is securing the downhole running downhole running tool to the completion assembly or second assembly.

The reset member 180 can be disposed on a second portion 109 of the body 105. In one or more embodiments, the reset member 180 can be a collet, such as a snap latch collet. The reset member 180 can include collet fingers or extensions 182. The collet fingers or extensions 182 can bend towards the central axis of the body 105 when exposed to a radial force. A mating shoulder or recess 184 can be formed within the inner diameter of an "upper" or first end portion 186 of the reset member 180. The shoulder or recess 184 can be configured to mate with or engage the second portion 109 of the body 105. Accordingly, the first portion 186 of the reset member 180 can be concentrically disposed about the second portion 109 of the body 105. In one or more embodiments, mechanical fasteners can be used to secure or otherwise affix the reset member 180 to the second portion 109 of the body 105.

The conduit 160 can be located between the first portion 107 and second portion 109 of the body 105. The hydraulic channel 160 can run axially within the body 105. The hydraulic channel 160 can be formed into the body 105 or in the alternative the hydraulic channel 160 can be a cable positioned within the body 105. A pressure relief port 150 can be disposed at a first end of the conduit 160, and a first flow port 165 can be disposed at a second end of the conduit 160. The pressure relief port 150 and first flow port 165 can be in communication with an outer diameter of the body 105 and can be sealed off from the annulus 106 within the body 105.

The pressure relief port 150 can be adapted to compensate for pressure build up and/or pressure drop within the conduit 160. The pressure relief port 150 can include a pressure relief valve, a tubing, a closed pressure cushion device, or any other mechanism capable of releasing pressure from within the conduit 160. A filter (not shown) can be disposed about the pressure relief port 150 and the conduit 160. The filter can protect fluid, such as a hydraulic fluid, within the conduit 160 from debris or fluid external to the conduit 160, such as wellbore fluid.

In one or more embodiments, the pressure relief port 150 can include a pressure relief valve and a closed pressure cushion (not shown). The closed pressure cushion device can be a piston, diaphragm, bellows, chamber filled with gas, or any other closed pressure containment device.

The first flow port 165 can be disposed within the body 105, and can allow for communication between the exterior of the body 105 and the conduit 160. The first flow port 165 can be a hole or opening formed through the body 105. The first flow port 165 can connect to a concentric union or other conduit coupling mechanism. In one or more embodiments, the first flow port 165 can have a nipple or other connection mechanism for connecting to an additional conduit or hydraulic control system.

One or more seal assemblies 170 can be disposed about the body 105. In FIG. 1, one seal assembly 170 is shown. The seal assembly 170 can include one or more seal elements 175 and one or more spacers 178 disposed between the seal elements 175. The seal elements 175 can be any known seal. At least one of the seal elements 175 can be positioned adjacent to the first flow port 165.

In one or more embodiments, the downhole running tool 100 can further include a top sub 190 connected to the body 105. The top sub 190 can include one or more engagement or locking members, such as threads, to connect or otherwise engage a work string in communication with the surface. A centralizer 195 can also be disposed about the top sub 190 to help guide the downhole running tool 100 downhole.

Figure 2:
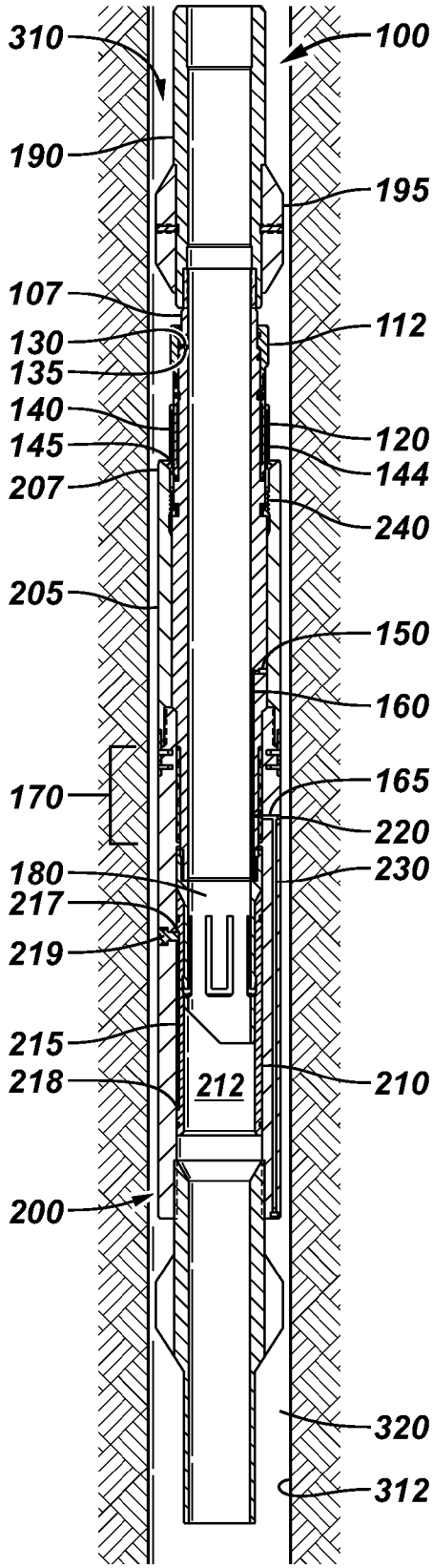
FIG. 2 depicts a partial cross section of an illustrative first assembly connected to an illustrative second assembly, according to one or more embodiments described.

FIG. 2 depicts a partial cross section of a first assembly connected to an illustrative second assembly according to one or more embodiments. The first assembly and second assembly can form a completion system. The first assembly is depicted as the downhole running tool 100, and the second assembly is depicted as a completion assembly 200. In one or more embodiments, the downhole running tool 100 can be part of the first assembly. The second assembly or completion assembly 200 can include a body or housing 205 having a bore formed therethrough. The first assembly or downhole running tool 100 can be at least partially positioned within the bore.

In one or more embodiments, the first portion 107 of the body 105 can be secured to or otherwise engaged with a first portion 207 of the housing 205 of the second assembly or completion 200. For example, the fingers or extensions 144 of the collet 140 can engage the inner diameter of the first portion 207 of the housing 205, and left handed threads 145 on the exterior of the collet 140 can mate with threads 240 on the inner diameter of the first portion 207 of the housing 205. The second sleeve 120 can ensure that the fingers 144 of the collet 140 do not bend towards the central axis of the body 105, even if a radial force is applied to the fingers 144; thereby, securing the first portion 207 of the housing 205 of the second assembly or completion assembly 200 to the first portion 107 of the body 105 of the first assembly or downhole running tool 100.

The first flow port 165 can be in fluid communication with a conduit 230 in the completion assembly 200 via a second flow port 220. When the first assembly or downhole running tool 100 is within the bore 206 of the second assembly or completion assembly 200, the seal assembly 170 can form a seal between the outer diameter of the first assembly or downhole running tool 100 and the inner diameter of the housing 205 of the second assembly or completion assembly 200, and the second conduit 230 can be protected from contamination caused by external fluid or debris.

The pressure relief port 150 can be in fluid communication with the second conduit 230 via the first conduit 160. Consequently, the pressure relief port 150 can ensure that the pressure within the second conduit 230 stays within a predetermined range even when the second assembly or the completion assembly 200 is exposed to a temperature gradient that increases pressure due to thermal expansion of fluid or hydraulic fluid within the first conduit 160 and the second conduit 230. The predetermined range can depend on the pressure rating of the first assembly or the downhole running tool 100 and the second assembly or the completion assembly 200.

Any device that uses hydraulic pressure for actuation can be in communication with the second conduit 230 and positioned adjacent to the second assembly or completion assembly 200. Such devices can include, but are not limited to, one or more packers, bridge plugs, sand control equipment, flow control valves, and formation isolation valves.

A protection mechanism 210 can be disposed in a "lower" or second portion 208 of the bore 206. The protection mechanism 210 can be an inner tubular component or sliding sleeve having a bore 212 formed therethrough. The protection mechanism 210 can be a ring or tubular member. The protection mechanism 210 can have a stroke limited between a first position or run-in position and a second position or reset position. The stroke can be limited to movement between the first position and second position by any movement limitation device. An illustrative movement limitation device or stroke limiter, as depicted in FIG. 2, can include a groove or slot 215 formed axially within a portion of the outer diameter of the protection mechanism 210. A first shoulder 217 can be formed adjacent to the "upper" or first end 214 of the slot 215 and a second shoulder 218 can be formed at the "lower" or second end 216 of the slot 215. The shoulders 217, 218 can be configured to engage at least one screw 219 radially disposed within the housing 205 and can align with the slot 215. Accordingly, the screw 219 can act like a limiter screw controlling the axial movement of the protection mechanism 210. The protection mechanism 210 can be configured to cover one or more completion flow ports when the protection mechanism 210 is in a second position or reset position. For example, the protection mechanism 210 can at least partially cover or protect the second flow port 220 formed into the housing 205, when the protection mechanism 210 is in a second position, such as when the second shoulder 218 is adjacent the screw 219. As such, the protection mechanism 210 can protect or shield the completion flow ports from wellbore debris or fluid when the protection mechanism 210 is in the second position.

The reset member 180 can be disposed within the bore 212 of the protection mechanism 210. The collet fingers or extensions 182 of the reset member 180 can engage the inner diameter of the protection mechanism 210. When the first assembly or downhole running tool 100 is fully engaged with the second assembly or completion assembly 200, the protection mechanism 210 can travel axially until the first shoulder 217 on the outer diameter of the protection mechanism 210 engages the limiter screw 219.

In operation, the first assembly or downhole running tool 100 and second assembly or completion assembly 200 can be run-into a wellbore 310 using a work string (not shown) that is connected to the top sub 190 of the first assembly or downhole running tool 100. The second assembly or completion assembly 200 can be positioned within the wellbore annulus 320 at a desired depth and the second assembly or completion assembly 200 can be anchored in place. For example, the second assembly or completion assembly 200 can include one or more packers (not shown) positioned thereon that can be actuated, setting the second assembly or completion assembly 200 within the wellbore annulus 320 formed between an inner wall of the wellbore 312 and the second assembly or completion assembly 200.

As the first assembly or downhole running tool 100 and the second assembly or completion assembly 200 are run-into the wellbore 310, the second assembly or completion assembly 200 and first assembly or downhole running tool 100 can encounter wellbore fluids. The wellbore fluids can be damaging to the conduit 230 and equipment in fluid communication with the conduit 230. For example, the well bore fluids can contaminate fluid within the conduit 230, such as hydraulic fluid. The first assembly or downhole running tool 100 can protect the conduit 230 from contamination by sealing off the conduit 230 thereby preventing wellbore fluid from flowing into the conduit 230. This can be accomplished by the seal formed between the interior of the second assembly or completion assembly 200 and the seal assembly 170, and the connection of the first flow port 165 to the second flow port 220.

Furthermore, as the second assembly or completion assembly 200 is conveyed into the wellbore, the second assembly or completion assembly 200 can encounter temperature gradients, for example, the second assembly or completion assembly 200 can be exposed to a temperature of 40° F. at the surface and 200° F. towards the bottom of the wellbore. The change in temperature can cause a pressure increase in the conduit 230; however, by communicating the conduit 230 with the pressure relief port 150, via conduit 160, any increase in pressure above a predetermined limit can be exhausted from the conduit 230, via pressure relief port 150. Therefore, the first assembly or downhole running tool 100 can protect the second assembly or completion assembly 200 from pressure increases due to temperature increases, due to thermal expansion of fluid within the closed conduit 230. The first assembly or downhole running tool 100 can protection the second assembly or completion assembly from debris or wellbore fluids.

The bore 106 pressure can cause the first sleeve 112 to shift axially away from the collet 140, and the shear pin 115 can break allowing the first sleeve 112 to move the second sleeve 120. When the second sleeve 120 shifts and moves away from between the body 105 and the fingers or extensions 144, the fingers or extensions 144 of the collet 140 are free to bend or collapse towards the central axis of the first assembly or downhole running tool 100. In the event that the second sleeve 120 continues to prevent the fingers 144 of the collet 140 from bending towards the central axis, the first assembly or downhole running tool 100 can be rotated from the surface to unthread the left handed threads 145 from the second assembly or completion assembly 200; thereby, freeing the first assembly or downhole running tool 100 from the first portion 207 of the second assembly or completion assembly 200.

Once the latch member 110 is released from the second assembly or completion assembly 200, the first assembly or downhole running tool 100 can be moved away from the second assembly or completion assembly 200 using an axial force applied to the drill string (not shown). As the first assembly or downhole running tool 100 moves away from the second assembly or completion assembly 200 the fingers 144 can bend towards the central axis of the body 105. Accordingly, the fingers 144 can disengage the inner diameter of the first end portion 207 of the housing 205 and the first assembly or downhole running tool 100 is free to move away from the second assembly or completion assembly 200. As the first assembly or downhole running tool 100 is removed from the completion bore the reset assembly 180 can slide the protection mechanism 210 up until the second shoulder 218 engages the screw 219. When the screw 219 engages the second shoulder 218 the inner diameter of the fingers 182 of the reset member 180 can disengage from the inner diameter of the protection mechanism 210, thereby, freeing the reset member 180 to move away from the protection mechanism 210. After the protection mechanism 210 is shifted up by the first assembly or downhole running tool 100, the protection mechanism 210 can seal off or protect the second flow port 220 from wellbore fluids and/or debris. As the first assembly or downhole running tool 100 is removed the first flow port 165 can disengage from the second flow port 220. The first assembly or downhole running tool 100, now fully disengaged from the second assembly or completion assembly 200, can be removed to the surface.

Figure 3:
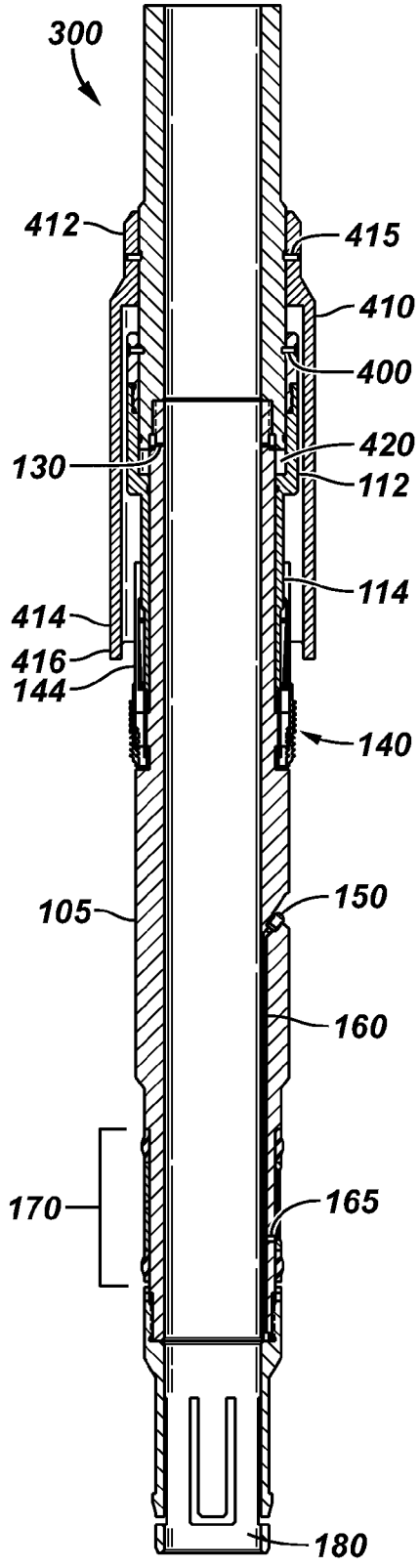
FIG. 3 depicts a partial cross section of another illustrative downhole running tool, according to one or more embodiments described.

FIG. 3 depicts a partial cross section of another illustrative downhole running tool 300, according to one or more embodiments. The downhole running tool 300 can have the first sleeve 112 disposed about the first portion 107 of the body 105. The first sleeve 112 can be secured to the body 105 by a first sleeve shear pin 400. The first sleeve shear pin 400 can be configured to break when the first sleeve 112 is actuated or shifted. The first sleeve 112 can be adapted to be actuated by pressure applied to an annulus of a wellbore (not shown). The outer diameter of the second portion 114 of the first sleeve 112 can be disposed between the body 105 and the collet 140. The outer diameter of the second portion 114 of the first sleeve 112 can support the fingers or extension 144 of the collet 140 and prevent the fingers 144 from bending toward the central axis of the body 105.

The pressure relief port 150 can be disposed about the body 105 and can be in communication with the conduit 160. The conduit 160 can be in communication with the first flow port 165. Seal assembly 170 can be disposed about the body 105 adjacent the first flow port 165. The reset mechanism 180 can be connected to the second portion 109 of the body 105.

A chamber 420 can be formed between the first sleeve 112 and the body 105 of the downhole running tool 300. The chamber 420 can communicate with the bore 106 via port 130. As the first sleeve 112 is shifted axially by the pressure applied to an annulus formed between the downhole running tool 300 and a wellbore, such as the annulus 320 of the wellbore 310, fluid within the chamber 420 will be forced into the bore 106 via port 130.

A shroud 410 can be disposed about the first portion 107 of the body 105. The shroud 410 can be production tubing or any other common downhole tubular member. An "upper" or first portion 412 of the shroud 410 can be secured to the first portion 107 of body 105. The first portion 412 of the shroud 410 can be secured by one or more shroud shear pins 415. The shroud shear pins 415 can break when there is a sufficient torque applied to the shroud 410. The torque can be applied to the shroud 410 by rotation of a drill string (not shown) connected to the upper sub 190, after the completion (not shown) is set downhole. A "lower" or second portion 414 of the shroud 410 can extend axially down a length of the body 105. A space can be formed between the second portion 414 of the shroud 410 and the exterior of the first sleeve 120. The terminal end 416 of the second portion 414 of the shroud 410 can have protrusions or extensions 430 formed thereon, as best described with reference to FIG. 4.

Figure 4:
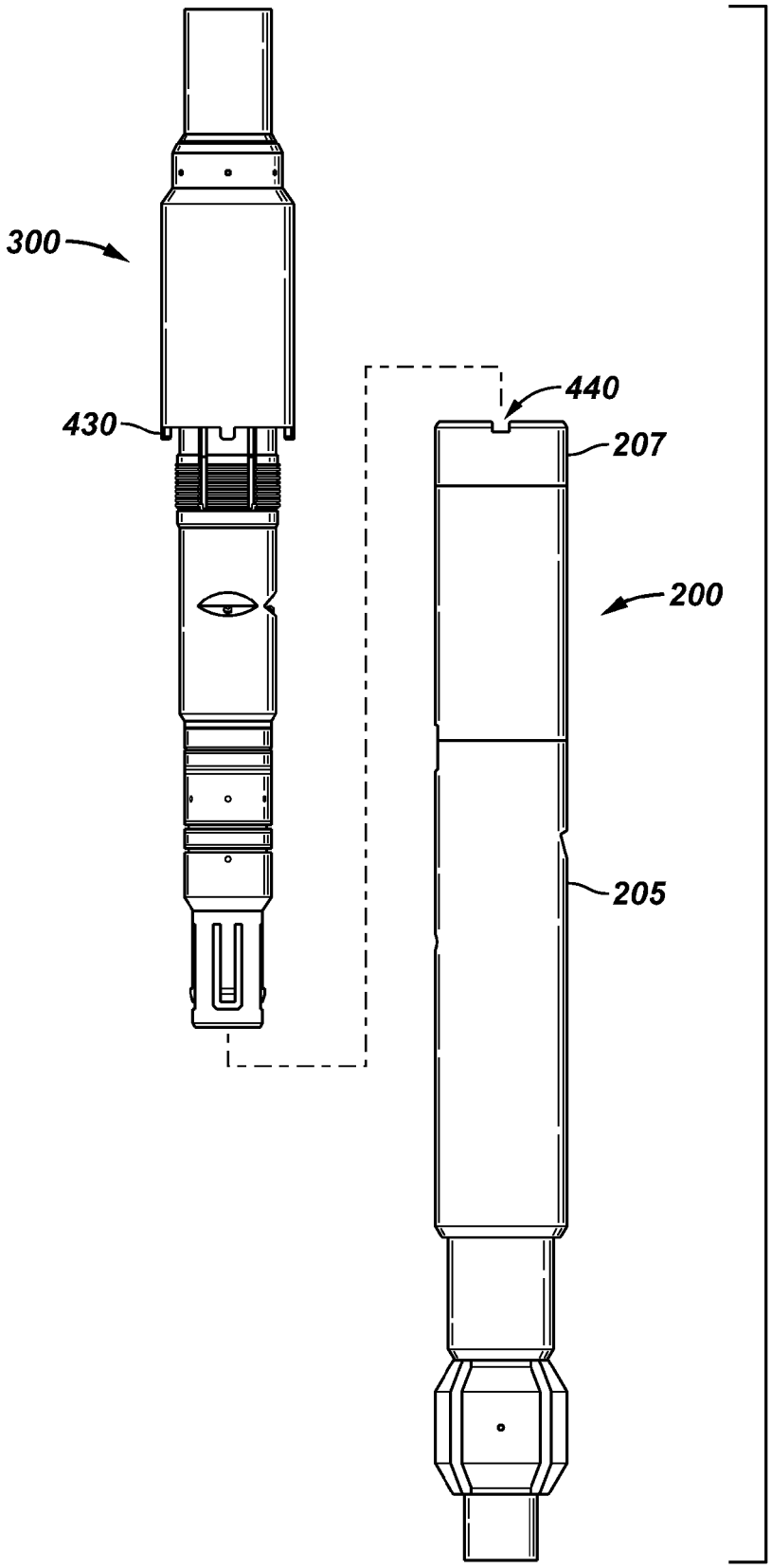
FIG. 4 depicts an isometric view of an illustrative downhole running tool and completion assembly, according to one or more embodiments described.

FIG. 4 depicts an isometric view of the illustrative downhole running tool 300 and the completion assembly 200. The extensions 430 can be configured to engage notches 440 formed into the upper portion 207 of the housing 205 of the completion assembly 200. The interaction of the notches 440 and extensions 430 can prevent the first assembly or downhole running tool 300 from rotating out of the second assembly or completion 200 during run-in operations.

The downhole running tool 300 can be secured to the second assembly or completion assembly 200 as described above in FIG. 2, and the extensions 430 can engage the notches 440. The first assembly or downhole running tool 300 and second assembly or completion 200 can be conveyed down a wellbore, such as wellbore 310, and the second assembly or completion 200 can be actuated as described above in FIG. 2. However, to release the first assembly or downhole running tool 300 from the second assembly or completion assembly 200 pressure can be applied to a wellbore annulus, such as wellbore annulus 320 in FIG. 2. The pressure can cause the first sleeve 112 to move axially away from the collet 140. When the first sleeve 112 is shifted axially, the second portion 114 of the first sleeve 112 no longer supports the fingers 144 of the collet 140 and they are free to bend towards the central axis. The first assembly or downhole running tool 300 can be removed from the second assembly or completion 200 in any manner including, but not limited to, manners substantially similar to the ones discussed above with reference to FIG. 3.

As used herein, the terms "up" and "down"; "upper" and "lower"; "upwardly" and "downwardly"; and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A completion system comprising:

a first assembly comprising:

a body having a bore formed therethrough;

a latch member disposed on a first portion of the body;

a reset member disposed on a second portion of the body;

a first conduit formed within a sidewall of the body, the first conduit located between the first and second portion of the body;

a pressure relief port disposed at a first end of the first conduit; and a first flow port disposed at a second end of the first conduit, wherein the pressure relief port and a first flow port are in communication with an outer diameter of the body and are sealed off from the bore within the body; and a second assembly comprising:

a housing with a bore formed therethrough, wherein the first assembly is disposed at least partially within the bore of the housing;

a first portion of the housing engaged with the latch member; a second flow port formed into the housing and sealed off from the exterior diameter of the housing, wherein the second flow port is engaged with the first flow port;

a second conduit formed within a sidewall of the housing and in communication with the second flow port; and a protection mechanism disposed within a second portion of the bore of the housing and engaged with the reset member, wherein:

the protection mechanism has a stroke limited between a first position and a second position, and wherein the protection mechanism covers the second flow port when the protection mechanism is in the second position.

2. The system of claim 1, wherein the first assembly and first flow port form a seal between the second conduit and the bore of the housing.

3. The system of claim 1, wherein the reset member is connected to the second portion of the body of the first assembly.

4. The system of claim 1, wherein the latch member comprises:

at least one sleeve; and a collet, wherein the at least one sleeve is disposed about an outer surface of the body and adapted to axially move about the outer surface of the body; and wherein at least a portion of the collet is disposed about an outer diameter of the at least one sleeve.

5. The system of claim 1, wherein the reset member comprises a collet disposed adjacent a second portion of the body, wherein the collet comprises one or more collapsible fingers adapted to engage an inner diameter of the protection mechanism.

6. The system of claim 1, further comprising at least one sealing element disposed about the body adjacent at least a portion of the first conduit.

7. A method for running-in a downhole completion comprising:

locating the completion system downhole; wherein the completion system comprises:

a first assembly comprising:

a body having a bore formed therethrough;

a latch member disposed on a first portion of the body;

a reset member disposed on a second portion of the body;

a conduit formed within a sidewall of the body, the conduit located between the first and second portion of the body;

a pressure relief port disposed at a first end of the conduit; and a first flow port disposed at a second end of the conduit, wherein the pressure relief port and a first flow port are in communication with an outer diameter of the body and are sealed off from the bore within the body; and a second assembly comprising:

a housing with a bore formed therethrough, wherein the first assembly is disposed at least partially within the bore of the housing;

a first portion of the housing engaged with the latch member;

a second flow port formed into the housing and sealed off from the exterior diameter of the housing, wherein the second flow port is engaged with the first flow port;

a second conduit formed within a sidewall of the housing and in communication with the second flow port; and a protection mechanism disposed within a second portion of the bore of the housing and engaged with the reset member; and the method further comprising:

protecting the second conduit within the second assembly from pressure buildup and external fluid as the completion system is located downhole;

actuating the second assembly;

releasing the first assembly from the second assembly;

removing the first assembly from the second assembly; and protecting the second flow port with the protection mechanism after the first assembly is removed.

8. The method of claim 7, wherein releasing the tool comprises applying pressure to a wellbore annulus formed between the first assembly and a wall of the wellbore or applying pressure to the bore of the body of the first assembly.

9. The method of claim 7, wherein releasing the first assembly comprises rotating the first assembly.

10. The method of claim 7, wherein protecting the second conduit from pressure build up further comprises compensating for pressure drop.

11. The method of claim 7, further comprising preventing the first assembly from rotating out of the second assembly while running the completion system downhole.

12. The method of claim 7, wherein protecting the second flow port formed into the second assembly after the first assembly is removed comprises moving the protection mechanism to a second position, wherein when the protection mechanism is in the second position the protection mechanism at least partially covers the second flow port, and wherein when the protection is in the second position the protection mechanism protects the second flow port from external fluid or debris.

* * * * *